United States Patent [19]

Weigert et al.

[11] 4,018,041

[45] Apr. 19, 1977

[54] FRICTION DISC FOR FALSE TWISTING APPARATUS

[75] Inventors: Hans Weigert, Schweinfurt; Kirit Patel, Elfershausen, both of Germany

[73] Assignee: Kugelfischer Georg Schafer & Co., Schweinfurt, Germany

[22] Filed: Apr. 13, 1976

[21] Appl. No.: 676,412

[30] Foreign Application Priority Data

Apr. 25, 1975 Germany ..... 2518538

[52] U.S. Cl. ..... 57/77.4

[51] Int. Cl.[2] ..... D02G 1/08

[58] Field of Search .... 57/34 R, 34 HS, 77.3–77.45

[56] References Cited

UNITED STATES PATENTS

| | | | |
|---|---|---|---|
| 3,811,258 | 5/1974 | Batsch | 57/77.4 X |
| 3,872,661 | 3/1975 | Eaves | 57/77.4 |
| 3,901,011 | 8/1975 | Schuster | 57/77.4 |
| 3,932,985 | 1/1976 | Naylor | 57/77.4 |
| 3,940,914 | 3/1976 | Schuster | 57/77.4 |
| 3,965,661 | 6/1976 | Yoshida | 57/77.4 X |

*Primary Examiner*—Donald E. Watkins
*Attorney, Agent, or Firm*—Stevens, Davis, Miller & Mosher

[57] ABSTRACT

A friction disc for an apparatus for the false twisting of threads such as, for example, for crimping synthetic threads, has a thread engaging surface with a high coefficient of friction and a convexly curved asymmetrical profile which is divided into three portions, each portion forming an arc of a circle having a different radius of curvature, the portion at the thread entry face extending over an arcuate length of about 90° up to the apex of the profile and having a radius of curvature equal to between 0.4S and 0.5S, while the intermediate portion of the profile has a radius of curvature substantially equal to S and the portion of the profile at the thread exit face has a radius of curvature equal to between 0.075S and 0.1S, S being the thickness of the disc.

4 Claims, 3 Drawing Figures

FRICTION DISC FOR FALSE TWISTING APPARATUS

Figure 1:
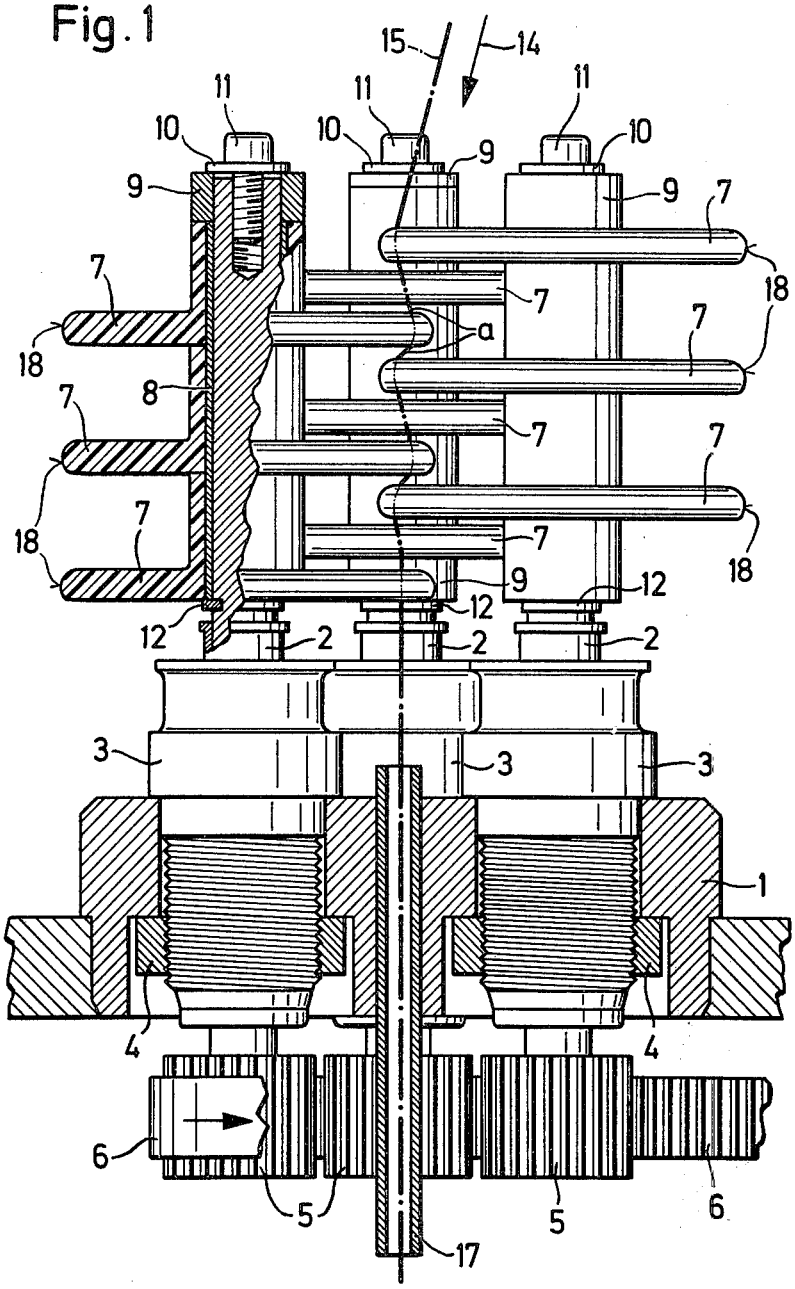

The invention relates to an apparatus for false twisting threads and more particularly to a friction disc for use in the friction false twisting of textile threads.

It is known to false twist threads primarily for the purpose of crimping synthetic threads by causing the thread to be rotated about its own axis by holding it in contact with a rotating friction disc. Various types of such devices already form the state of the art.

For example, in one known class of device, sets of friction discs are arranged on three rotatably mounted spindles which, in plan view, lie at the corners of an equilateral triangle. Each spindle is provided with at least one disc and the thread which is to be false-twisted runs in a zig-zag path between the discs.

As a rule, the rims of the friction discs at least in the region of the surface which is engaged by the thread to be false-twisted, are made of a material having a suitable high co-efficient of friction and of a predetermined selected hardness and resilience. This material is often a polyurethane. Instead of this, a ceramic coating has been provided over the thread-engaging surface of the disc to provide discs having a long working life. Also, discs have already been proposed with the thread-engaging surfaces coated with embedded wart-like outwardly projecting hard particles of substantially uniform grain size, preferably synthetic diamonds with a polycrystalline structure and relatively rounded shape, embedded in a nickel alloy (our U.S. patent application Ser. No. 611,859 filed Sept. 10, 1975).

In order to obtain a satisfactory friction false twist without excessive tension on the thread and to allow the friction disc to be manufactured and assembled and adjusted without very close tolerances, it is also known to make such discs with the thread-engaging surfaces of at least two materials having respectively a higher co-efficient of friction for imparting the false twist and a lower co-efficient of friction for guiding the thread over the disc, the engaging surface being formed of mutually adjacent annular portions of these two different coefficients of friction U.S. Pat. No. 3,901,011.

Generally speaking, the rims of the friction discs are made cylindrical, or are made, at least in the region of the thread-engaging surface with a semi-circular cross-sectional form or a semi-circular profile.

The cylindrical shape is unsatisfactory on account of the fact that two arcuate edges at the sides of the cylindrical periphery, over which the thread to be false-twisted runs, have a relatively large degree of influence on the false-twisting process even when these edges are rounded off. The desired tangential thread entry and also departure to and from the engaging surface are not achieved.

In order to be able to false-twist the thread in question satisfactorily without subjecting the thread to undesirably high tension loads, which can lead to breakage, a closely controlled thread path over the disc is necessary, yet the peripheral velocity at the rim of the disc has to be, as far as possible, the same at all points in contact with the thread. These requirements are contradictory.

In particular they are not fulfilled in friction discs with a thread-engaging surface of substantially semi-circular profile and with the whole of the thread-engaging surface made of a material of a suitable high co-efficient of friction.

With these discs, in particular in order to avoid thread breakages and to achieve an effective imparting of the false twist, very high standards have been set in the accuracy of manufacture and relative placing and adjustment, and indeed they have to take into account the characteristics of the particular thread to be false-twisted. In devices with mutually overlapping friction discs the tolerances for the degree of overlap, the thickness of the discs, the diameter of the discs and the axial spacing between adjacent discs are in particular extremely close, so that there is difficulty in maintaining them in quantity production. Those tolerances, which have to be maintained if one is to achieve satisfactory substantially uniform quality of the false twist in a number of threads of the same kind on different devices, while keeping thread breakages within practical limits, simply cannot be maintained in practice.

Account is taken of these difficulties in the above-mentioned proposal from the subject of our U.S. Pat. No. 3,901,011, according to which the thread-engaging surface of the disc is made up of at least two mutually adjacent annular portions made respectively of a material of higher co-efficient of friction for imparting the false twist and a material of lower co-efficient of friction for guiding the thread over the disc.

However, this arrangement does not entirely eliminate the influence of the annular portion or portions provided solely for guiding the thread. Also the axial separation between the friction discs of a friction false twisting device equipped with them cannot be reduced to the extent that the free stretch of thread between the thread-engaging surface portions of high coefficient of friction of two adjacent friction discs is as small as possible. Yet it has been found that it is particularly advantageous to provide for the disposition of the discs to be as close as possible with as short a free thread length between them as possible.

Accordingly, a friction disc has already been proposed (German Patent Application No. P24 56 882.9) of which the thread-engaging surface is made solely of a single material of suitable high co-efficient of friction with respect to the thread and the region of this surface over which the thread passes and by which the thread is rolled, has a convexly bulged profile with a flat bulge or curvature in such a way that the alteration $\Delta r$ or the radius $r$ of the disc over the breadth of the thead-engaging surface $s$ is less than $0.35s$, and therefore the radius $r$ of the disc alters only to a predetermined small extent from one end of the thread-engaging surface at one face of the disc to the other end of the thread-engaging surface at the other face of the disc. Preferably the profile follows an arc of a circle. The radius $r$ of the disc can for example increase progressively from the value $r_{min}$ at one end of the thread-engaging surface up to the value $r_{max} - + \Delta r_{max}$ at the apex of the profile in the middle of the thread-engaging surface, in order than again to fall away to the value $r_{min}$ at the other end of the thread-engaging surface, $\Delta r_{max}$ being less than $0.35s$ (where $s$ is the breadth of the thead-engaging surface).

In this way, primarily when a number of such friction discs are arranged in a friction false-twisting device at a close axial spacing, not only is the passage of the thread over the thread-engaging surface of the disc satisfactory but also the thread enters and leaves in the desired tangential manner. This close spacing of the discs is something to be aimed at because then the thread is left free in the device only over relatively short stretches, being guided on the thread-engaging surfaces of the discs practically throughout its passage through the apparatus.

An object of the present invention is to improve further the previously proposed friction disc so that the main relationships mentioned are achieved to the optimum extent, in particular any influences that have a significant adverse effect on the imparting of the twist, chiefly in the thread-entry region of the thread-engaging surface, are satisfactorily overcome.

Figure 2:
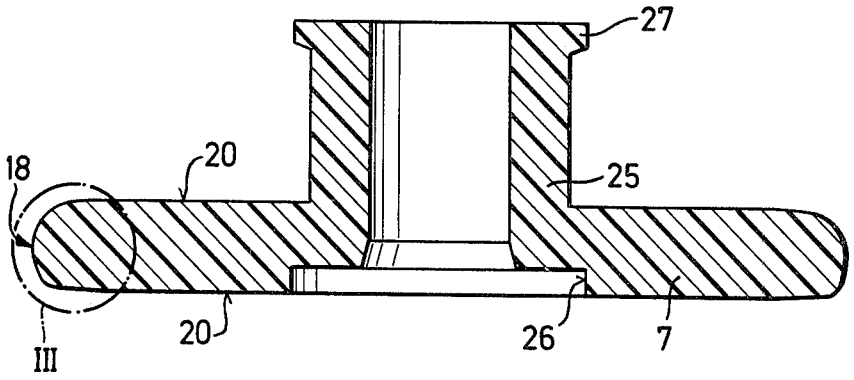
Figure 3:
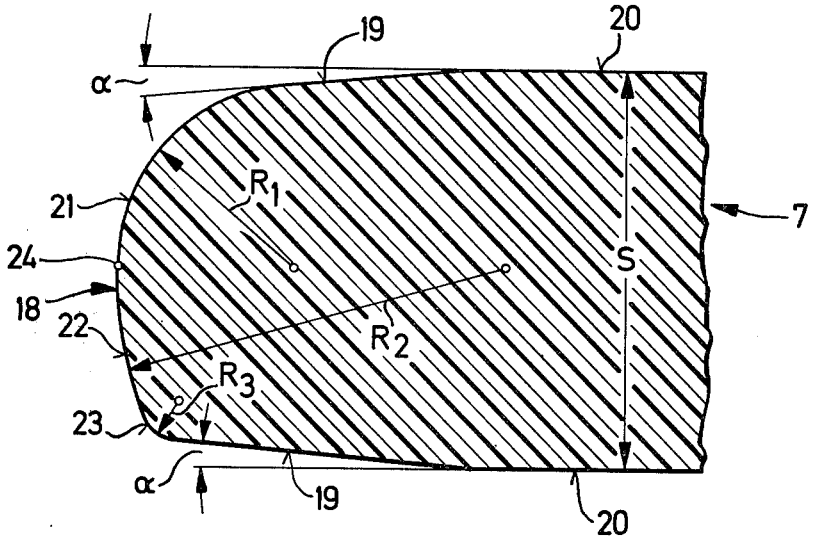

Other objects will become apparent from the following description of the invention with reference to the accompanying drawing wherein FIG. 1 is a side elevation, partially in section, of an embodiment of the falst-twisting device provided by the invention;

FIG. 2 is a longitudinal section through one embodiment of the friction disc used in the device of FIG. 1; and FIG. 3 is an enlarged view of that portion of the friction disc of FIG. 2 enclosed in circle III.

The foregoing objects of the invention and others are accomplished by providing a friction disc for friction false twisting of threads and a device provided with such friction discs having a thread-engaging surface made of a material of a suitable high co-efficient of friction and having a convexly curved asymmetrical profile, distinguished by the feature that the profile is divided into three portions, each forming an arc of a circle of different radius of curvature, the portion at the thread entry face extending over an arcuate length of about 90° up to the apex of the profile and having a radius of curvature equal to between 0.4S and 0.5S, while the intermediate portion of the profile has a radius of curvature substantially equal to S and the portion of the profile at the thread exit face has a radius of curvature equal to between 0.075S and 0.1S, (S being the thickness of the disc as shown in FIG. 3).

Thus the friction disc according to the invention does not have the conventional convexly bulged thread-engaging surface profile corresponding to an arc of a circle of a predetermined radius over its whole breadth. On the contrary the profile of the thread-engaing surface is made up of respective arcuately curved portions of different radius of curvature, the portion of the profile at the thread entry face being provided with a substantially greater radius of curvature $R_1$ as compared with the radius of curvature of the profile of the disc previously proposed, thereby eliminating any adverse edge effect.

It is known to provide friction discs for friction falsetwisting of threads with an asymmetrical profile at the periphery, namely with an arcuately curved circular profile between one face of the disc having a larger diameter other face having a smaller diameter (U.S. Pat. Spec. No. 2,718,111).

An embodiment of the invention by way of example is described in the following in conjunction with the accompanying drawings which are diagrammatic.

The false-twisting apparatus shown in FIG. 1 comprises a base plate 1 carrying three spindles 2. These spindles are arranged with their axes parallel to one another and, in plan view, lie at the corners of an equilateral triangle. Each spindle 2 is provided with a sealed bearing 3 which is secured to the base plate 1 by a nut 4. In addition, at its lower end as viewed in FIG. 1, each spindle 2 is provided with an externally toothed pinion 5. All three pinons 5 are embraced by a common internally toothed belt 6. Accordingly, in use, all three spindles 2 rotate in the same direction.

Mounted on each spindle 2 is a set of three friction discs 7, each comprising a hub and an annular flange at one end of the hub. The discs 7 of each set are secured next to one another on a common locating sleeve 8. The sleeve 8 is fitted onto the associated spindle 2 together with at least one spacing bushing 9 and is secured to the spindle, to rotate with it, by a washer 10 and a screw 11. The opposite end of the sleeve 8 from the washer 10 and screw 11 engages an abutment ring 12 mounted on the spindle 2.

The sets of discs, which are identical, are mounted on their respective spindles 2 with the discs 7 at different axial positions. This is achieved by the bushings 9. On the left-hand spindle 2 in FIG. 1 such a bushing 9 is provided above the set of discs and the same is true of the right-hand spindle 2, but in the latter case the set of discs is inverted. On the central spindle 2 there are two bushes 9, namely a taller one below and a shorter one above the set of discs, which set is arranged the same way up as those on the left-hand spindle 2.

Thus the discs 7 overlap one another and, in use, they all rotate in the same direction. The thread 15, which runs through the apparatus in the direction of the arrow 14, i.e., from top to bottom, thus has a Z-twist imparted to it. As it passes through the apparatus it follows a helical path of substantially uniform helix angle, i.e., it runs along a helical path around an imaginary cylindrical surface, leaving the apparatus through a stationary tubular balloon-preventer 17. The balloon-preventer 17 passes through the base plate 1 and is secured to it at the center of the above-mentioned triangle of spindles.

The thread 15 is pressed against each disc 7 and partially embraces an engaging surface 18 on it, so as to be rolled against it. The engaging surface 18 merges at each end through a chamfer 19 (necessary for production reasons) into the respective adjacent face 20 of the disc 7, as shown in particular in FIG. 3. The chambers 19 are each inclined to the adjacent face 20 at an angle $\alpha$ of from 3° to 8°.

Each disc 7 is made, at least in the region of its engaging surface 18, solely from a material of suitable high co-efficient of friction with respect to the thread. As likewise shown particularly clearly in FIG. 3, the engaging surface 18 has an asymmetrical convexly curved profile.

According to the invention the profile of the thread engaging surface 18 is divided into three portions 21, 22 and 23. These are each of a profile forming an arc of a circle and each has a different radius of curvature $R_1 = (0.4 \text{ to } 0.5)S$ and $R_2 = S$ and $R_3 = (0.075 \text{ to } 0.1)S$ and $R_2 = S$ and $R_3 = (0.075 \text{ to } 0.1)S$, $S$ being the thickness of the disc. The portion 21 of the profile at the thread entry face extends over an arcuate length of about 90° up to the apex 24 of the profile, i.e., to that point at which the disc 7 has its greatest diameter.

By this shape the result is achieved that despite the very close axial spacing of the discs 7 in the apparatus according to FIG. 1 and the consequent relatively short free stretches of thread *a* the thread 15 not only follows the engaging surface 18 of each disc 7 in an ideal manner but also it enters and leaves the ends of the surface tangentially. The relatively large radius of curvature $R_1$ of the portion 21 of the profile at the thread entry face of th disc 7 prevents any damaging edge effect on the imparting of the twist.

As shown in FIG. 2 the disc 7 has at that face which is away from its hub 25 a recess 26 into which, in the arrangement according to FIG. 1, the beaded end 27 of the hub 25 of the adjacent disc 7 fits. This is not shown in FIG. 1.

Although the invention is described in detail for the purpose of illustration, it is to be understood that such detail is solely for that purpose and that variations can be made therein by those skilled in the art without departing from the spirit and scope of the invention except as it may be limited by the claims.

What we claim is:

1. In a friction disc for friction false twisting of threads, said disc having a thread-engaging surface having a high co-efficient of friction and a convexly curved asymmetrical profile which is divided into three portions, each forming an arc of a circle of different radius of curvature, the portion at the thread entry face extending over an arcuate length of about 90° up to the apex of the profile and having a radius of curvature equal to between 0.4S and 0.5S, while the intermediate portion of the profile has a radius of curvature substantially equal to S and the portion of the profile at the thread exit face has a radius of curvature equal to between 0.075S and 0.1S S being the thickness of the disc.

2. A friction disc according to claim 1 having a chamfer at both sides of the thead-engaging surface.

3. A friction disc according to claim 2 in which the chamfer makes an angle of between 3° and 8° with the adjacent face of the disc.

4. The friction disc of claim 1 having a polyurethane thread-engaging surface.

* * * * *